United States Patent [19]

Kimura

[11] Patent Number: 4,977,771

[45] Date of Patent: Dec. 18, 1990

[54] DEVICE FOR BENDING THIN METALLIC PIPE

[75] Inventor: Sadao Kimura, Numazu, Japan

[73] Assignee: USUI Kokusai Sangyo Kaisha Ltd., Japan

[21] Appl. No.: 455,991

[22] Filed: Dec. 22, 1989

[30] Foreign Application Priority Data

Dec. 30, 1988 [JP] Japan ..... 58-332185

[51] Int. Cl.[5] ..... B21D 7/02

[52] U.S. Cl. ..... 72/218; 72/214; 72/215; 72/381; 72/388

[58] Field of Search ..... 72/215, 216, 217, 218, 72/219, 221, 381, 387, 388

[56] References Cited

U.S. PATENT DOCUMENTS

| | | | |
|---|---|---|---|
| 72,669 | 12/1867 | Noland . | |
| 183,190 | 10/1876 | McWilliams . | |
| 328,986 | 10/1885 | Warwick . | |
| 411,941 | 10/1889 | Taft . | |
| 641,535 | 1/1900 | McKibben . | |
| 747,466 | 12/1903 | McClellan . | |
| 910,282 | 1/1909 | Gerlock . | |
| 1,911,028 | 5/1933 | Maxwell et al. . | |
| 1,970,182 | 8/1934 | Odenbach et al. | 72/218 |
| 2,108,271 | 2/1938 | Samuel . | |
| 2,305,850 | 12/1942 | Drysdale . | |
| 2,366,012 | 12/1944 | Draper et al. . | |
| 2,476,596 | 7/1949 | Green . | |
| 2,964,085 | 12/1960 | Ghiringhelli . | |
| 3,420,279 | 1/1969 | Tuit . | |
| 3,531,963 | 10/1970 | Garner et al. | 72/217 |
| 3,732,721 | 5/1973 | Cusimano . | |
| 3,788,122 | 1/1974 | Ritter et al. . | |
| 4,090,387 | 5/1978 | Dubreuil . | |
| 4,249,407 | 2/1981 | Fogleman . | |
| 4,662,204 | 5/1987 | Saegusa . | |
| 4,735,075 | 4/1988 | Saegusa . | |
| 4,785,650 | 11/1988 | Lusty | 72/217 |
| 4,805,436 | 2/1989 | Saegusa . | |
| 4,938,050 | 7/1990 | Kimura | 72/306 |

FOREIGN PATENT DOCUMENTS

| | | | |
|---|---|---|---|
| 383620 | 10/1923 | Fed. Rep. of Germany . | |
| 1176967 | 8/1964 | Fed. Rep. of Germany . | |
| 136458 | 7/1952 | Sweden . | |
| 691227 | 10/1979 | U.S.S.R. | 72/217 |
| 0884789 | 11/1981 | U.S.S.R. | 72/217 |
| 259126 | 10/1926 | United Kingdom . | |

*Primary Examiner*—David Jones

[57] ABSTRACT

The present invention provides a device for bending thin metallic pipes suitably used as a fuel supply pipe, brake pipe and the like of an automobile, which are bent at a plurality of portions thereof not in the same direction but in three-dimensional directions. The device according to the invention includes a stationary mold form having a first and a second bending section to the shapes of which a metallic pipe is bent and a guide member erected upright on the mold form at the second bending section, a bending member arranged outside the mold form and movable toward the latter for bending the metallic pipe, a rotor for rotating the bending member and an actuator for operating the rotor through a wire. The advantages of the invention are that unlike the conventional device, the bending member located outside the mold form is attached to the rotor which is rotated by the actuator through the wire, the interference of the actuator with the metallic pipe or other parts of the device or with another actuator is prevented and the structure of the device is simplified.

9 Claims, 7 Drawing Sheets

DEVICE FOR BENDING THIN METALLIC PIPE

BACKGROUND OF THE INVENTION

1. Field of the Invention

The present invention relates to a device for bending a thin metallic pipe at a number of portions and more particularly to such type of device that is suitable for a case in which the bending directions of the bending portions of the pipe are not in the same plane but different in three-dimensional directions as in the cases of a fuel pipe, brake pipe and the like for an automobile.

2. Description of the Prior Art

Heretofore, the bending device of the above type has had the structure such that as described in the specification of U.S. patent application Ser. No.340,224 filed on Apr. 19, 1989 by the present applicant in relation to a thin metallic pipe bending device, one end, or the intermediate portion, of a straight metallic pipe is fixed bY a clamp and a bending member is gradually moved forward or circularly from the fixed end, or the fixed intermediate portion, of the pipe toward the free end, or both free ends, of the pipe so that the metallic pipe is bent along a mold form while it is pressed against the mold form.

However, the conventional thin metallic pipe bending device has had the problems that since it is necessary to provide an actuator, e.g., a cylinder at each bending section of the mold form, the cylinder interferes with other parts of the device, or the cylinders themselves interfere with each other so that they are unable to be installed or they have to be set by using a complicated mechanism and further that the actuator interferes with the moving metallic pipe when the pipe is turned round due to its bending.

SUMMARY OF THE INVENTION

Accordingly, an object of the present invention is to provide a bending device which can be manufactured easily and at low cost without the necessity of taking into consideration of the inteference between the cylinders as actuators and other parts of the device, between the cylinders themselves or between the device and the metallic pipe.

In order to achieve the above object, the thin metallic pipe bending device of the present invention includes a stationary mold form formed by connecting rod members or tubular members and having a configuration substantially coinciding with the shape to which a thin metallic pipe is bent throughout the entire length thereof, at least one of first and second bending sections formed on the mold form such that the first bending section includes a first guide surface having, in the longitudinal direction, a radius of curvature smaller than the radius of curvature with which the corresponding portion of the pipe is bent and running substantially normal to the pipe bending plane in the cross direction and the second bending section includes a second guide surface substantially parallel to the pipe bending plane, a guide member erected on the mold form in substantially normal relationship with the second guide surface and having a radius of curvature smaller than the radius of curvature with which the corresponding portion of the pipe is bent, a bending member arranged outside the mold form and movable toward the latter so as to bend the metallic pipe along the first guide surface at the first guide section and along the second guide surface and the guide member at the second bending section; a rotor rotatably attached to each of the bending sections and adapted to rotate the bending member and an actuator for operating the rotor through a wire such as a release wire.

Thus, according to the present invention, the metallic pipe is bent by the stationary mold form and the bending member movable from outside the guide member through the actuator such as an air cylinder, rotary actuator and the like so that the metallic pipe is bent along the guide surface or both the guide surface and the guide member. That is, the rotor attached with the bending member is rotatably attached to the stationary mold form directly or through a bracket so that the deflection of the stays supporting the mold form is prevented and further, since, in a preferred embodiment of the present invention, the pipe is bent in a state in which the piston rod of the air cylinder is withdrawn instead of being pushed as has been the case of the conventional device, and through the wire, no bending moment is applied on the piston rod at the time of completion of bending and no adverse effect generates due to the loosening of the piston rod bush so that the generation a delicate inconsistency (discontinuity) between the piston rod and the bending member can be prevented. In addition, as the release wire is used at the portion where there is a danger of interference between the actuator and any other parts of the device or the actuators themselves or between the actuator and the metallic pipe, the setting position of the actuator, e.g. an air cylinder, can be selected freely and the rotor attached with the bending member can be operated by properly making the wire extend roundabout. Accordingly, the installation of the actuator is facilitated and the entire device can be simplified and miniaturized.

DETAILED DESCRIPTION OF PREFERRED EMBODIMENTS

Figure 1:
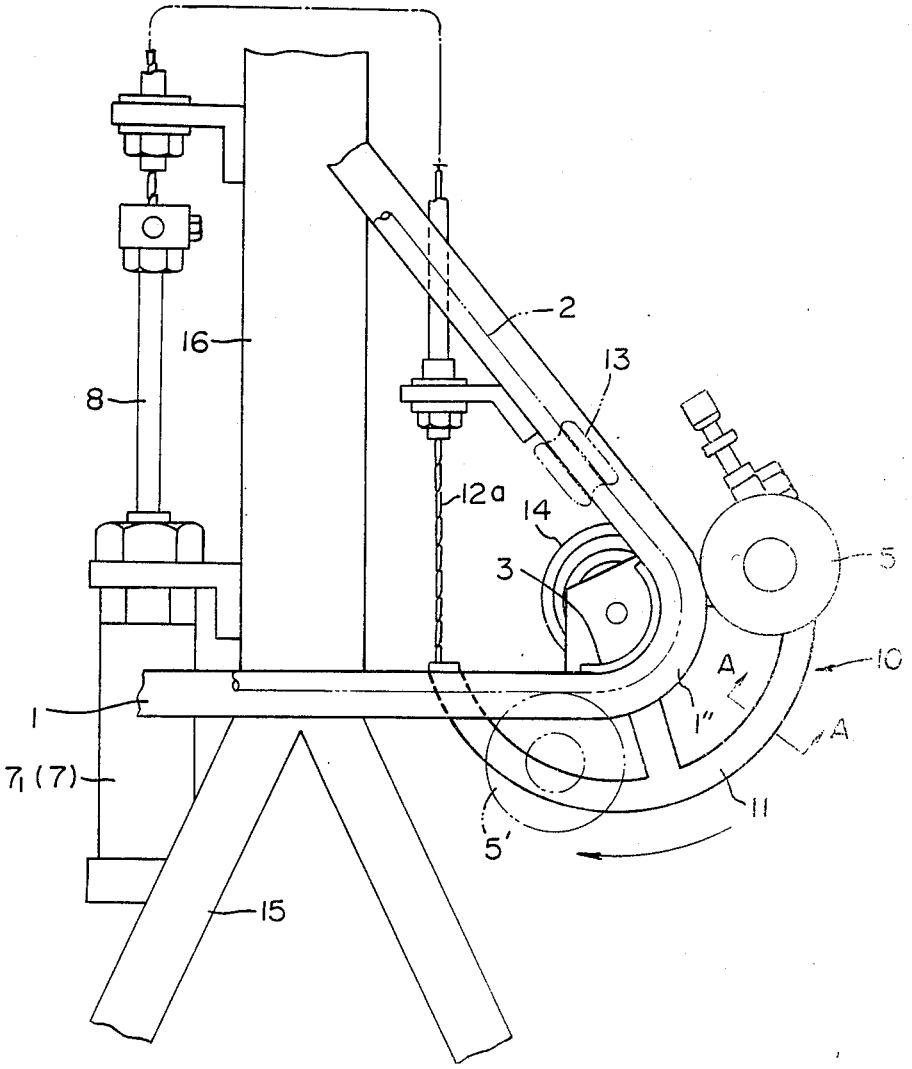
FIG. 1 is a front view of an essential portion of one embodiment of the present invention.
Figure 2:
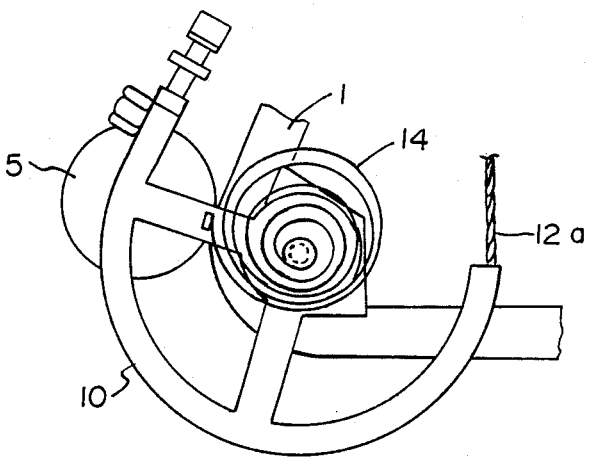
FIG. 2 is a rear view of a part of the same.
Figure 3:
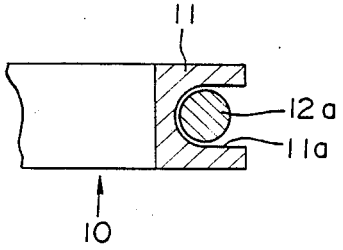
FIG. 3 is a sectional view taken along the A-A line of FIG. 1.
Figure 4:
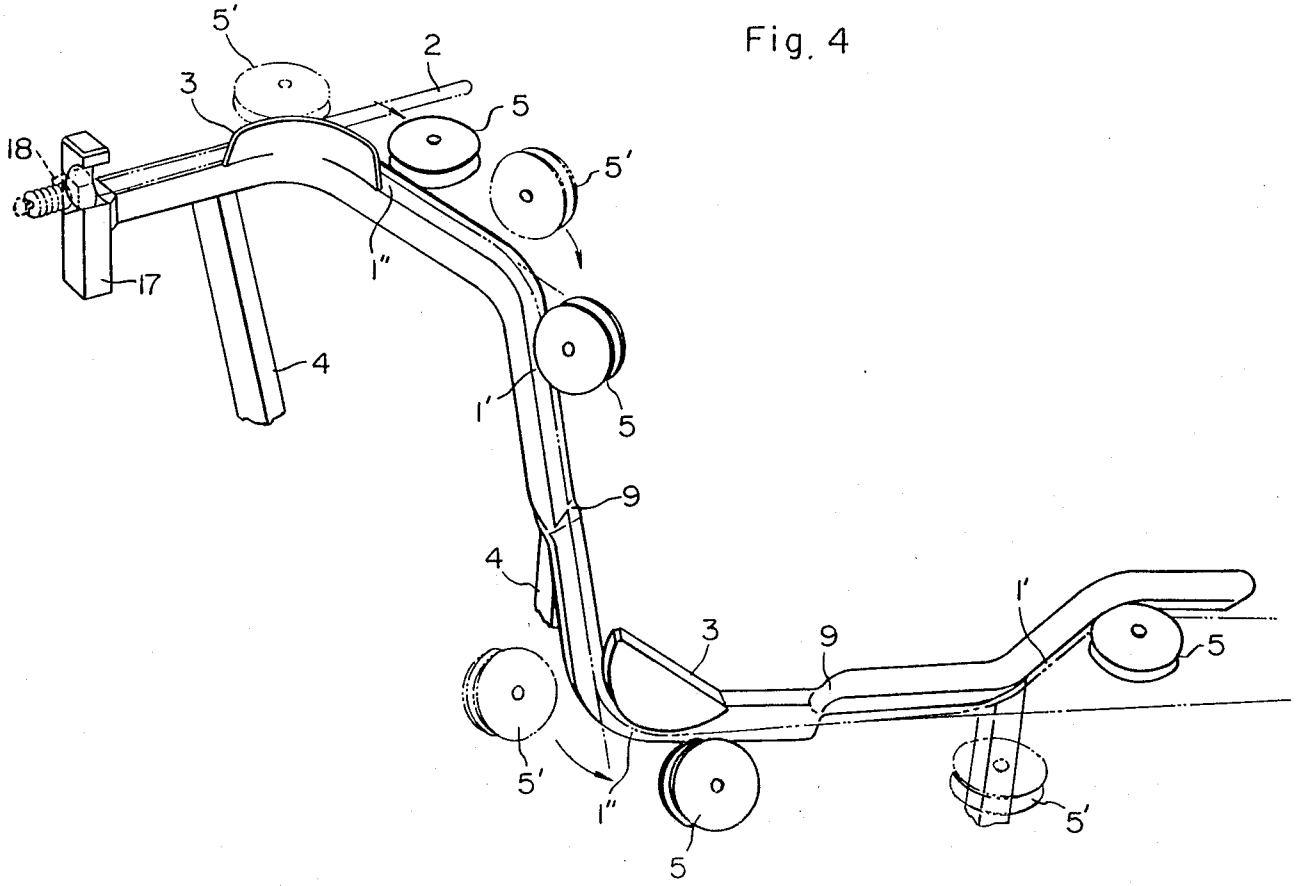
FIG. 4 is a schematic perspective view of a stationary mold form as an element of the embodiment of the present invention.

As shown in FIG. 4, a stationary mold form 1 is made of an elongated member comprising a pluralitY of rods or pipes coupled together by welding as at 9. The mold form 1 is of a shape to which a metallic pipe 2 is desired to be bent throughout the entire length thereof and includes substantially vertical first guide surfaces 1' and substantially horizontal second guide surfaces 1''. Further, the mold form 1 includes a flat portion in section or it is preferably square in section but the sectional configuration of the second guide surface 1'' may be circular and in that case, the second guide surface 1'' will be a line tangential to the outer peripheral surface of the metallic pipe 2 extending substantially normal to each of guide members 3 which are erected, by welding, at desired portions of the mold form 1. Each of the guide members 3 has a radius of curvature smaller than the bending radius of the metallic pipe 2 and which lies substantially normal to the first and second guide surfaces 1' and 1'. The radius of curvature and the shape of each the guide members 3 and mold form 1 are determined in consideration of the possible backlash of the metallic pipe 2 at the time of bending. Further, the guide member 3 may be in the form of a plate or a block and the mold form 1 is fixed to a base plate by means a desired number of stays 4 or may be merely supported by the stays without the base plate provided that the stays are connected together. Designated by reference numeral 5 are bending members each capable of moving along the stationary mold form 1 while pressing the metallic pipe 2 against the first guide surface 1' or the second guide surface 1''. The bending member 5 for bending the metallic pipe 2 along the first guide surface 1' is arranged to face that surface and that for bending the metallic pipe 2 along the second guide surface 1'' is so arranged that it can move along that surface substantially parallelly or at a slight angle of inclination. Reference numeral 5' designates the bending member 5 at a position to which it is retired when the metallic pipe 2 is not subjected to bending. Further, as shown in FIGS. 1 and 2, the bending member 5 is fixed to a sector rotor 10 rotatably fixed near each of positions where the metallic pipe 2 is bent. The sector rotor 10 includes a pulley section 11 connected with an inner wire **12*a* of a release wire 12 which is in turn connected to an actuator 7 such as a piston rod 8 of an air cylinder 7 arranged at a suitable portion of the device not interfering with other parts of the device, through a groove 11*a* provided on the pulley section 11**.

Figure 5:
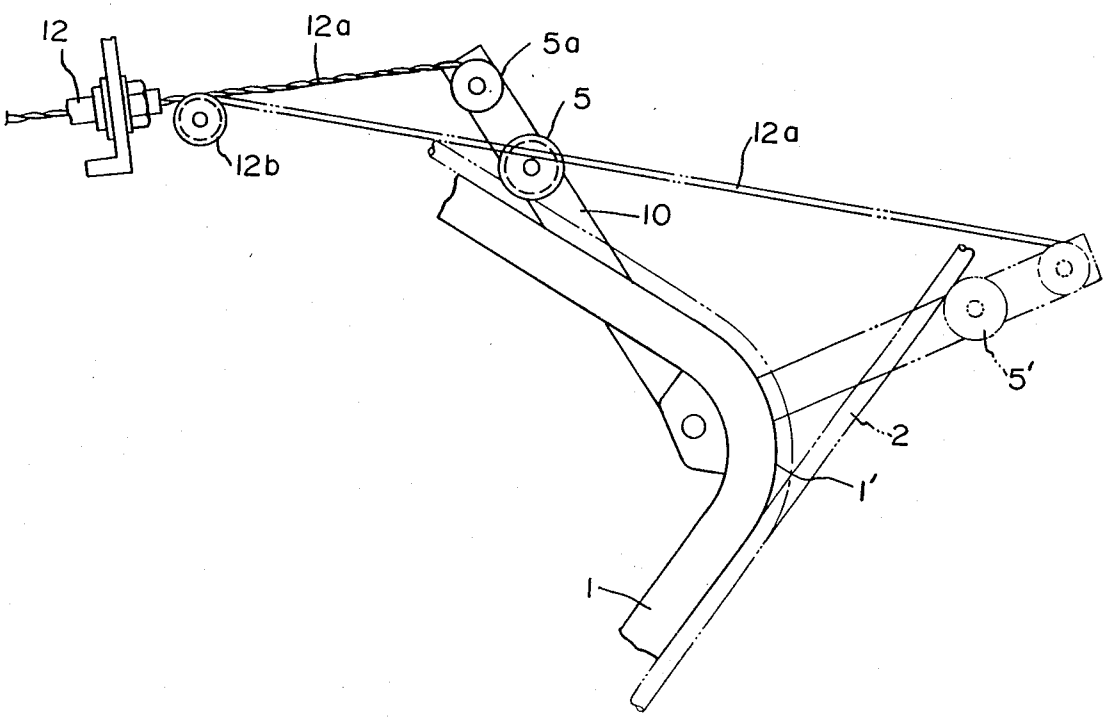
FIG. 5 is a front view of an essential portion of another embodiment of the present invention; FIG. *6a* and *6b* are respectively a side view and a perspective view of still another embodiment of the present invention.
Figure 6A:
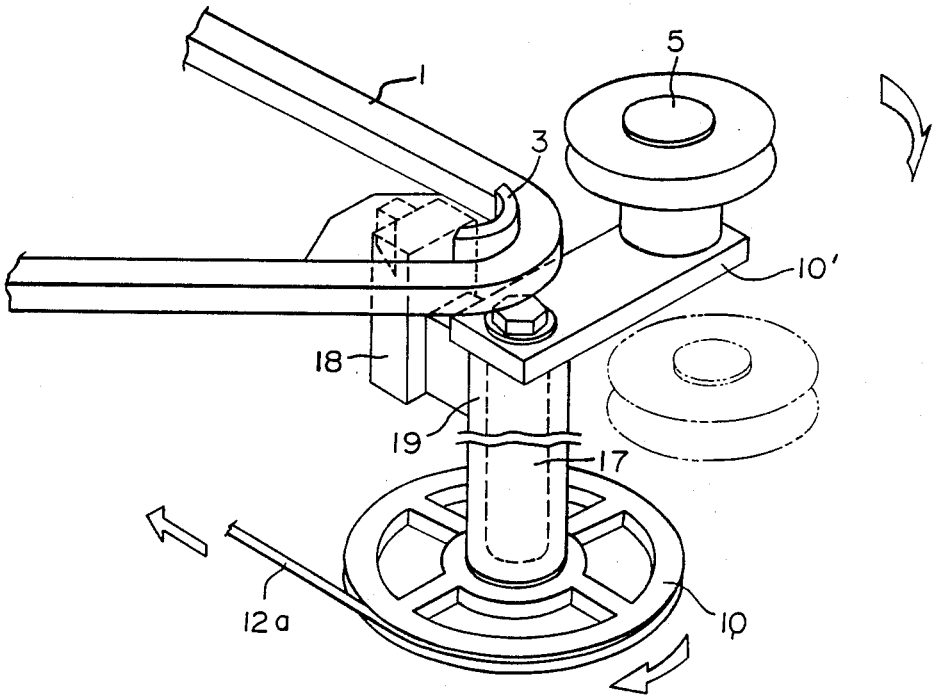
Figure 6B:
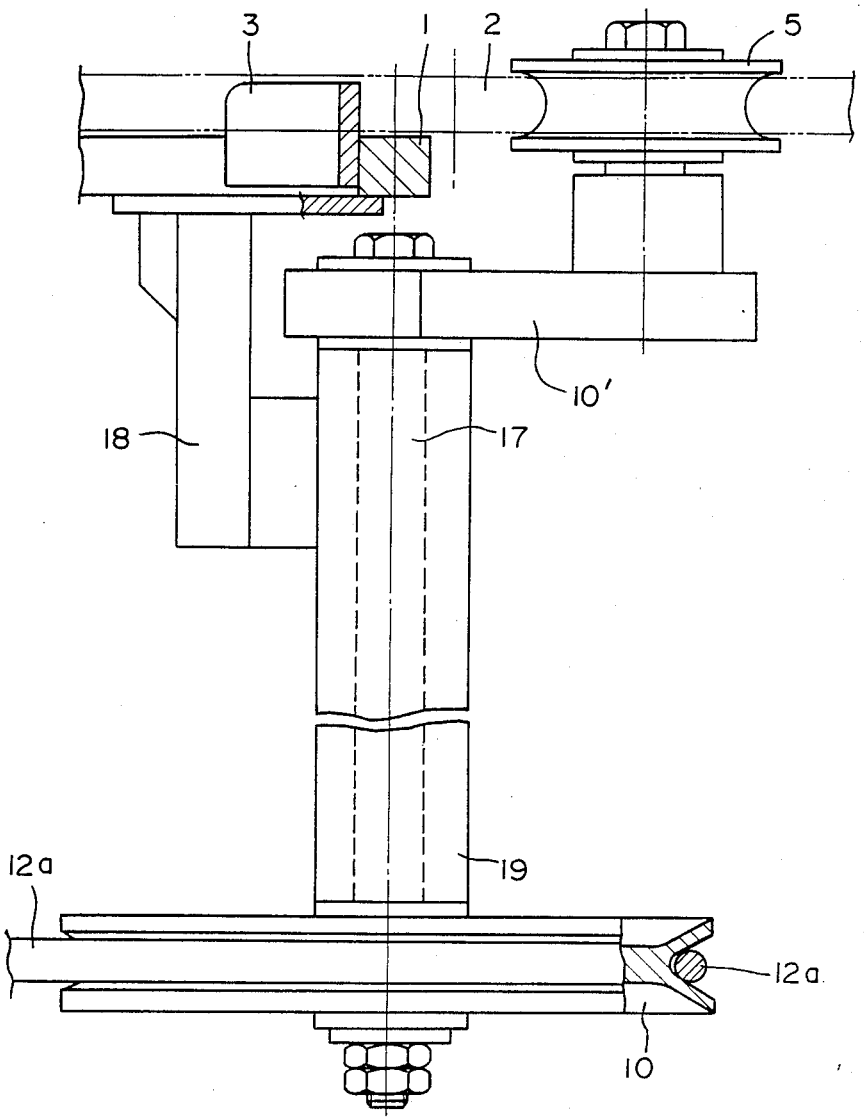

The shape of the rotor 10 is not necessarily be sectorial but it may be in the form of a lever as shown in FIG. 5 wherein the leverlike rotor 10 is provided, at the outer end thereof, with a roller **5*a* so as to guide, and prevent the abrasion of, the inner wire 12*a* and a guide roller 12*b* is provided short of the position at which the inner wire 12*a* is inserted into the release wire 12**.

In the above structure, the bending member 5 attached to the rotor 10 and the cylinder $7_1$ (actuator 7) can be connected in spaced apart relationship with each other through the wire 12 so that the metallic pipe 2 can be bent without the necessity of taking into consideration of the interference of the cylinder $7_1$ with the other parts of the device, the interference among the cylinders $7_1$ themselves and that between any of the cylinders $7_1$ and the metallic pipe 2.

Further, where it is not possible to rotate the rotor 10 due to the existence of the other parts of the device in the rotational track of the rotor 10, the rotor 10 may be arranged as shown in FIGS. **6*a* and 6*b* . That is, the bending member 5 attached with a lever 10' at one end thereof and the rotor 10 are respectively welded to both ends of a rod 17 which is rotatably supported by a tubular member 19 provided at one end of a beam 18 fixed to a fixing section comprising the frame 1, a base 15 or a stay 16, or to any suitable structure other than the device so that the rotor 10 can be rotated without interfering with the other parts of the device as it is held spaced from the bending member 5**.

In the embodiment of FIGS. **6*a* and 6*b* , the phase between the bending member 5 and the rotor 10 can be changed as desired and the space between the bending member 5 and the rotor 10 can be changed by selectivelY changing the length of the rod 17**.

Thus, when, prior to bending the pipe 2, the air cylinder 7 is actuated while the front part of the bending portion of the pipe 2 is pressed by a presser 13, the bending member 5 rotates with the rotor 10 bY the action of the inner wire **12*a* so that the pipe 2 is bent along the first and second guide surfaces 1' and 1'' and the guide member 3. For returning the bending member 5 to the original position, a spiral spring 14 attached to the rotor 10 is used but instead of using such mechanism, one end of the inner wire 12*a* may be fixed to the rear end of a double-rod type cylinder so that the rotor is rotated with the reciprocating motions of the cylinder or a rotary actuator is used for returning the bending member 5**.

Figure 7:
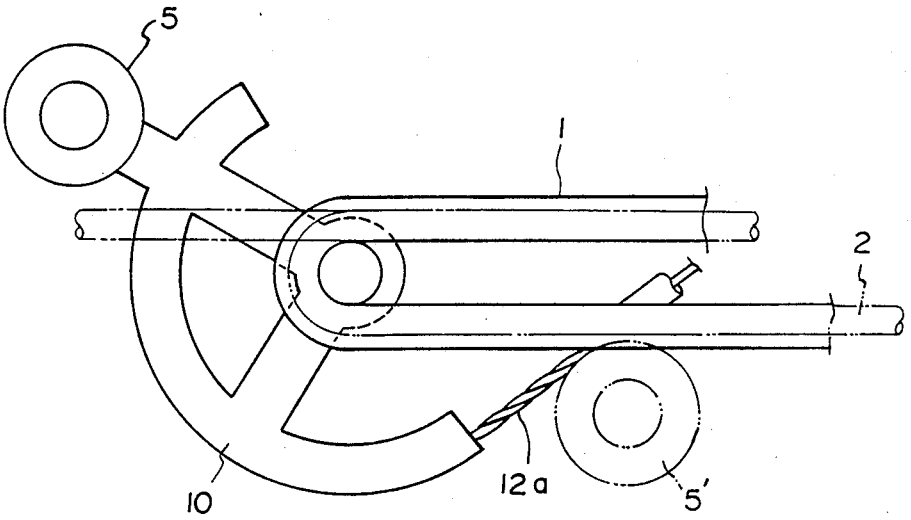
FIG. 7 is a front view of an essential portion of a further embodiment of the present invention.

Thus it is possible with the above structure to bend the metallic pipe by 180° as shown in FIG. 7.

Next, how to bend the metallic pipe 2 will be described. One end of the straight metallic pipe 2 is first fixed by a hook 17 attached to one end of the stationary mold form 1 by means of an end metal 18 as shown in FIG. 4 or a suitable position at the intermediate portion of the pipe sized by a stopper is fixed by a clamp (not shown). Then the bending member 5 is pressed against the pipe 2 and moved from the fixed portion of the pipe 2 to the free end thereof (in the case of the former arrangement) or from the fixed intermediate portion of the pipe 2 to both free ends thereof (in the case of the latter arrangement) while causing the pipe 2 to be brought into pressure contact with the first and second guide surfaces 1' and 1'' and the guide member 3. It should be noted that the bending device of the present invention can be used for bending not only a metallic pipe but also a rod material and further that although each of the cylinders is used as an actuator in the shown embodiments, a rotary actuator (not shown) may be used in its place or the actuators 7 for operating the inner wire **12*a*** may be concentrated in a control panel in combination with a speed reducer, clutch, encoder and microcomputer so that the bending device is fully automated. Moreover, when a control panel is arranged at the job site in combination with the bending device of the present invention, a bending operation can be performed immediately by the device.

As described above, according to the present invention, the metallic pipe 2 is bent by the stationary mold form 1 and the bending member 5 movable from outside the guide 3 toward the stationary mold form by the action of each of the actuators 7 which are fixed to the mold form 1 directly or indirectly through stays 4 or brackets so that the pipe 2 is bent along the first guide surface 1' or the guide member 3 and the second guide surface 1''. In other words, as the rotor attached with the bending member 5 is rotatably fixed to the stationary form 1 directly or through the bracket, the deflection of the stays supporting the stationary mold form 1 can be prevented and further, as the bending member 5 is, in one of the above described preferred embodiment of the invention, operated by the actuator 7 through the wire 12 in a state in which the piston rod of the cylinder as the actuator is withdrawn instead of its being pushed (extended), the adverse effect due to the loosening of the piston rod bush taking place with the conventional device is eliminated and no bending moment is applied on the piston rod of the actuator 7. Accordingly, a delicate inconsistency (or discontinuity) between the bending member 5 and the guide member 3 is prevented thereby producing a highly accurate bent product.

Moreover, where the bent sections of the mold form 1 are close to each other and each of the actuators interferes with other parts of the device or the actuators themselves interfere with each other or with the metallic pipe at the time of bending so that the entire device becomes complicated or the bending operation becomes impossible, the rotor attached with the bending member may be provided near each of the bent sections while the bending member is rotated by the wire through each actuator arranged at a desired position so that the installation of the device is facilitated without the necessity of using a complicated mechanism, which results in increasing the degree of freedom of designing the device and securing an uninterrupted bending operation. Accordingly, the structure of the entire bending device is simplified resulting in sharply reducing the number of the required parts as compared to the conventional device therebY contributing to the minaturization and weight reduction. Further, due to the above advantages, the manufacturing cost can be sharply reduced and since the material is bent in an extremely short time, the device can be placed in an operative condition without fail a the time of starting mass production. Moreover, since each of the actuators can be arranged at a desired position, it may be of large horse power and even a thick and hard metallic pipe can be bent with a small radius of curvature.

What is claimed is:

1. A device for bending a thin metallic pipe into a shape having at least first and second bends, each said bend defining a bending plane and a radius of curvature, said device comprising; a stationary mold form having a configuration substantially coinciding with the shape to which the metallic pipe is bent throughout the entire length thereof; at least first and second elongated bending sections formed on the stationary mold form, said first bending section including, in its longitudinal direction, a first guide surface having a radius of curvature smaller than the radius of curvature of the first bend of the metallic pipe said first guide surface extending in a cross direction substantially normal to the bending plane of the first bend of the metallic pipe and said second bending section including a second guide surface running substantially parallel to said bending plane of the second bend in the metallic pipe and a guide member provided on said stationary mold form in a direction substantially normal to said second guide surface and having a radius of curvature smaller than that of the second bend of the metallic pipe; each said bending section having a bending member located radially outside said stationary mold form and movable toward the stationary mold form so that the metallic pipe is bent along said first guide surface at said first bending section, and subsequently along said second guide surface and said guide member at said second bending section; a rotor rotatably attached to said stationary mold form at a position corresponding to at least one of said bending sections and adapted to rotate the respective bending members; an actuator for operating said rotor through a wire; and means for automatically returning the rotor and the associated bending member to the position radially outside the stationary mold form.

2. A device according to claim 1, wherein said bending member is attached to said rotor.

3. A device according to claim 2, wherein said rotor is in the shape of a sector of a circle.

4. A device according to claim 1, wherein said rotor and said bending member are respectively attached to both ends of a shaft which is rotatably held by a beam fixed to the device.

5. A device according to claim 1, wherein said rotor is in the shape of a lever and is attached with said bending member and a roller is provided for guiding the wire to rotate said rotor.

6. A device according to claim 1 wherein the means for automatically returning the rotor and the associated bending member to the position radially outside the stationary mold form comprises a spring.

7. A device according to claim 1 comprising a plurality of actuators for operating said rotor through a wire at each of said bending sections, one of said actuators at each said bending section defining the means for automatically returning the rotor and the associated bending member to the position radially outside the stationary mold form.

8. A device according to claim 1 wherein the actuator is a double-rod type cylinder having a pair of alternately extensible rods connected respectively to opposed ends of the wire, one said rod defining the means for automatically returning the rotor and the associated bending member to the position radially outside the stationary mold form.

9. A bending device for sequentially and automatically placing at least first and second bends in an elongate thin metallic pipe, each said bend in said pipe defining a bend plane and a radius of curvature, said device comprising a stationary mold form having a configuration substantially conforming to the shape to which the pipe is bent throughout the entire length thereof, said stationary mold form including a first bending section having an elongated first guide surface bent in its longitudinal direction to define a radius of curvature generally corresponding to the radius of curvature of the first bend for the pipe and having a cross direction extending substantially normal to the bend plane of the first bend of the pipe, said stationary mold form further comprising a second bending section having an elongated second guide surface extending substantially parallel to the bending plane of the second bend in the pipe and a guide member extending normal to the second guide surface and a defining a radius of curvature generally corresponding to the radius of curvature of the second bend in the pipe, each said bending section having a bending member located radially outside of said stationary mold form and being movable toward the stationary mold form for bending the pipe against the stationary mold form, each said bending section further comprising an actuator and a wire operative connected to the actuator for selectively moving the bending member toward the stationary mold form, said device further comprising means for selectively returning the bending member to the location spaced radially outside said stationary mold form, whereby the location of each said bending member radially outside the stationary mold form and the disposition of the actuator are selected to avoid interference as the pipe is sequentially bent by the bending members of the device.

* * * * *